US005370047A

United States Patent [19]

Compton

[11] Patent Number: 5,370,047

[45] Date of Patent: Dec. 6, 1994

[54] FLEXOGRAPHIC PRESS ADAPTED FOR SHORT RUNS AND METHOD

[75] Inventor: Craig T. Compton, Green Bay, Wis.

[73] Assignee: Paper Converting Machine Company, Green Bay, Wis.

[21] Appl. No.: 160,575

[22] Filed: Dec. 1, 1993

[51] Int. Cl.[5] ..... B41F 27/00

[52] U.S. Cl. ..... 101/216; 101/375; 101/477; 101/485

[58] Field of Search ..... 101/219, 212, 216, 375, 101/378, 152, 153, 477, 485, 174, 415.1

[56] References Cited

U.S. PATENT DOCUMENTS

| | | | |
|---|---|---|---|
| 4,119,032 | 10/1978 | Hollis | 101/216 |
| 4,386,566 | 7/1983 | Moss | 101/375 |
| 4,697,516 | 10/1987 | Rombout | 101/216 |
| 4,913,048 | 4/1990 | Tittgemeyer | 101/216 |
| 5,010,813 | 4/1991 | Buffo | 101/216 |
| 5,042,788 | 8/1991 | Bowman | 270/21.1 |
| 5,048,418 | 9/1991 | Hars et al. | 101/178 |
| 5,101,726 | 4/1992 | Lübke et al. | 101/375 |
| 5,140,899 | 8/1992 | Greer et al. | 101/348 |
| 5,289,769 | 3/1994 | Hickok | 101/218 |

*Primary Examiner*—Eugene H. Eickholt
*Attorney, Agent, or Firm*—Tilton, Fallon, Lungmus & Chestnut

[57] ABSTRACT

Flexographic press structure and operation which includes a plurality of decks each removably supporting a plate roll and an anilox roll with each roll including a sleeve rotatably mounted on a stationary mandrel and supported at the ends thereof, the press is equipped with a lifter at one end to free each roll from its support at the other end whereby the sleeve can be removed over the other end.

12 Claims, 4 Drawing Sheets

FLEXOGRAPHIC PRESS ADAPTED FOR SHORT RUNS AND METHOD

BACKGROUND AND SUMMARY OF INVENTION

This invention relates to a flexographic press adapted for short runs and method and, more particularly to a press having plate and anilox rolls each using a dead shaft mandrel about which a sleeve is rotatably mounted and having associated therewith lift means for sleeve removal.

When changing to the next print job on a flexographic printing press, the plate rolls and often the anilox (inking) rolls need to be replaced. This is because the new plates replace those previously mounted on the plate rolls and, in many cases, the ink cell volume on the anilox roll needs to be adjusted for the new print job.

Traditionally, flexographic presses support the inking roller (anilox roller) and plate roller on bearings which open to release the rolls for job change. Once open, the rolls are lifted out of the press using a chain hoist or custom designed robot.

The market for just-in-time print jobs has continued to increase the demand for shorter change times on presses. Likewise, the average job size is rapidly decreasing. This has spawned a new class of press which is narrower than the typical wide-web (30 to 65 inch wide), long run press. The new press is also intended to be quickly changed from one job to the next by only one person.

One solution to fast roll change which is possible on medium width presses (16 to 30 inch wide) is to use plate sleeves instead of plate rolls (i.e., plate sleeves fit over a mandrel whereas plate rolls have bearing journals). Because of the narrower width, these sleeves can be of a weight which can be lifted by hand (10 to 25 lb.). Two types of sleeves have been used. The first style is the "simply" supported plate roller.

In this style, the plate roll consists of a sleeve which is locked onto a mandrel. During printing the roll is rotatably supported in bearings at each side of the press. For sleeve removal, the mandrel is cantilever supported from one side while the opposing bearing is dropped away from the mandrel. This is analogous to unchucking a mandrel in a center winder such as that seen in co-owned U.S. Pat. No. 2,769,600. The plate sleeve is then released from the mandrel and slid sideways to remove it from the press.

The problem with this arrangement is that the deck designs to allow the bearing and support to drop away (giving clearance for removal) are bulky, complex and costly. The problem is aggravated by the operator requirements to connect register control actuators to the roll.

The second style is the "cantilever" supported plate roller. Recently, a press has been developed which only supports the plate and anilox mandrels from one side of the press. This provides natural access for sleeve removal. The major problem with this design is that, for presses wider than about 16 inches, the printing-performance is impaired due to the limited stiffness provided by a cantilever support. Additionally, the mechanism to allow precise adjustment of the roll positions are complex, sensitive and expensive.

The invention avoids the above problems through cantilever mounting a mandrel on which a sleeve is mounted and providing means for raising the mandrel and sleeve to provide advantageous clearance. Further, the sleeve is not fixed to the mandrel but instead rotates on the stationary mandrel (commonly called a dead shaft).

BRIEF DESCRIPTION OF DRAWINGS

The invention is described in conjunction with the accompanying drawing, in which.

DETAILED DESCRIPTION

Figure 1:
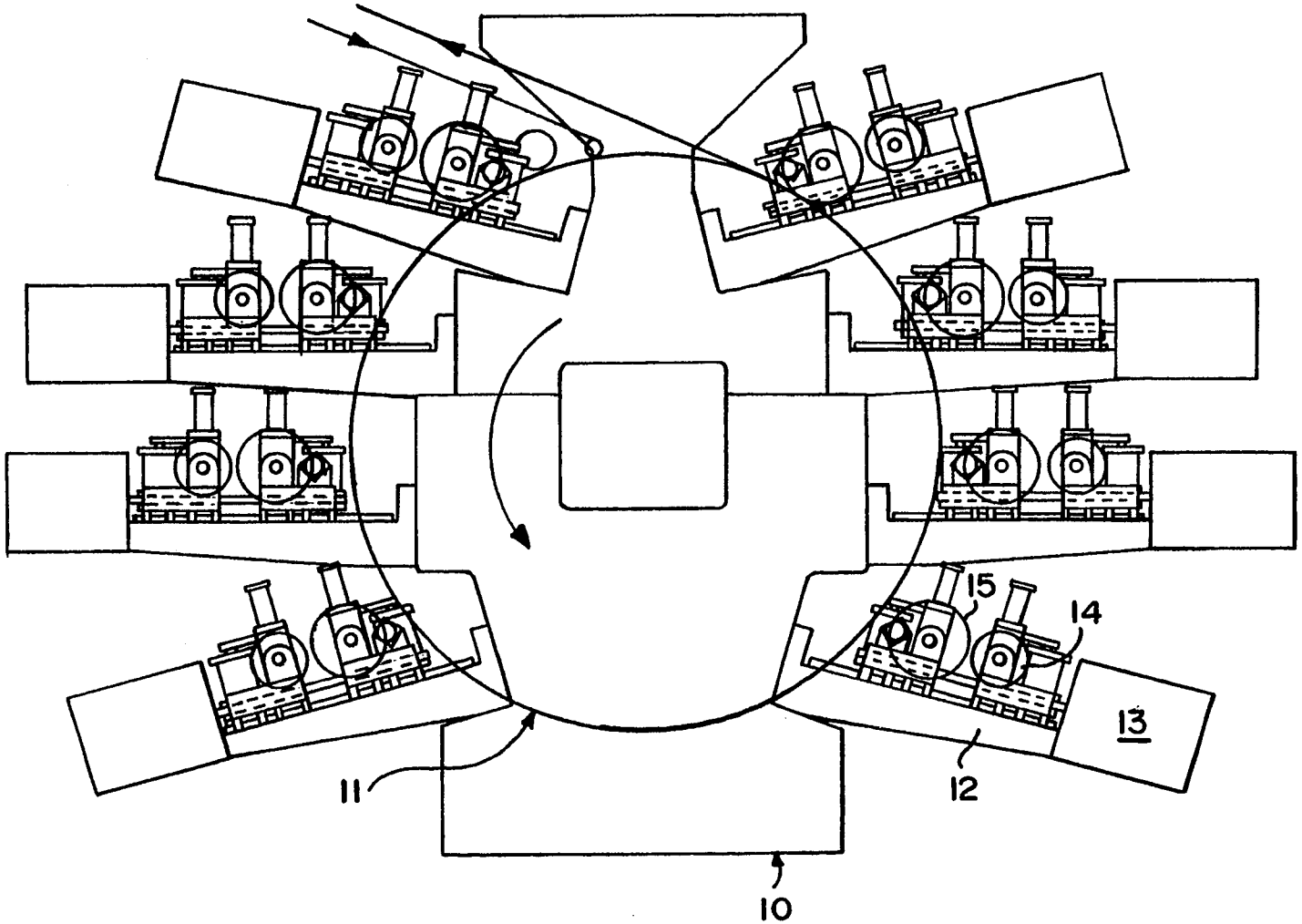
FIG. 1 is a side elevational view of an eight-deck central impression cylinder flexographic press.
Figure 3:
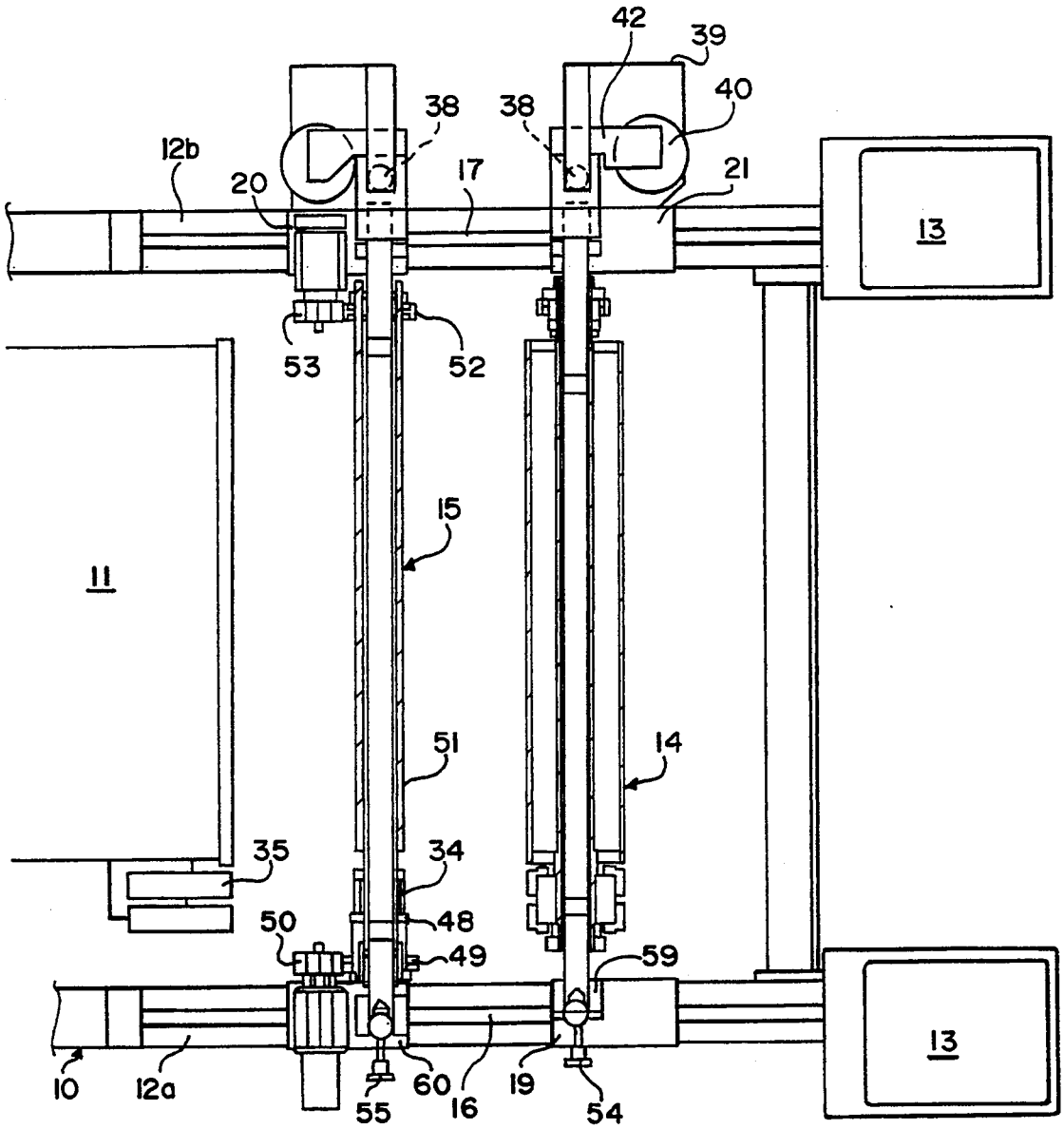
FIG. 3 is a developed plan view of the deck construction of FIG. 2.

In the illustration given and with reference first to FIG. 1, the numeral 10 designates generally the main frame of the press. Rotatably supported on the main frame is a central impression cylinder 11. Disposed about the central impression cylinder 11 are a plurality of deck frames 12. Each deck frame 12 supports enclosures 13 for deck positioning motors (see FIG. 3 also), an anilox roll or cylinder generally designated 14 and a plate roll or cylinder generally designated 15. This much is conventional and can be seen in greater detail in co-owned U.S. Pat. No. 4,520,728.

Figure 2:
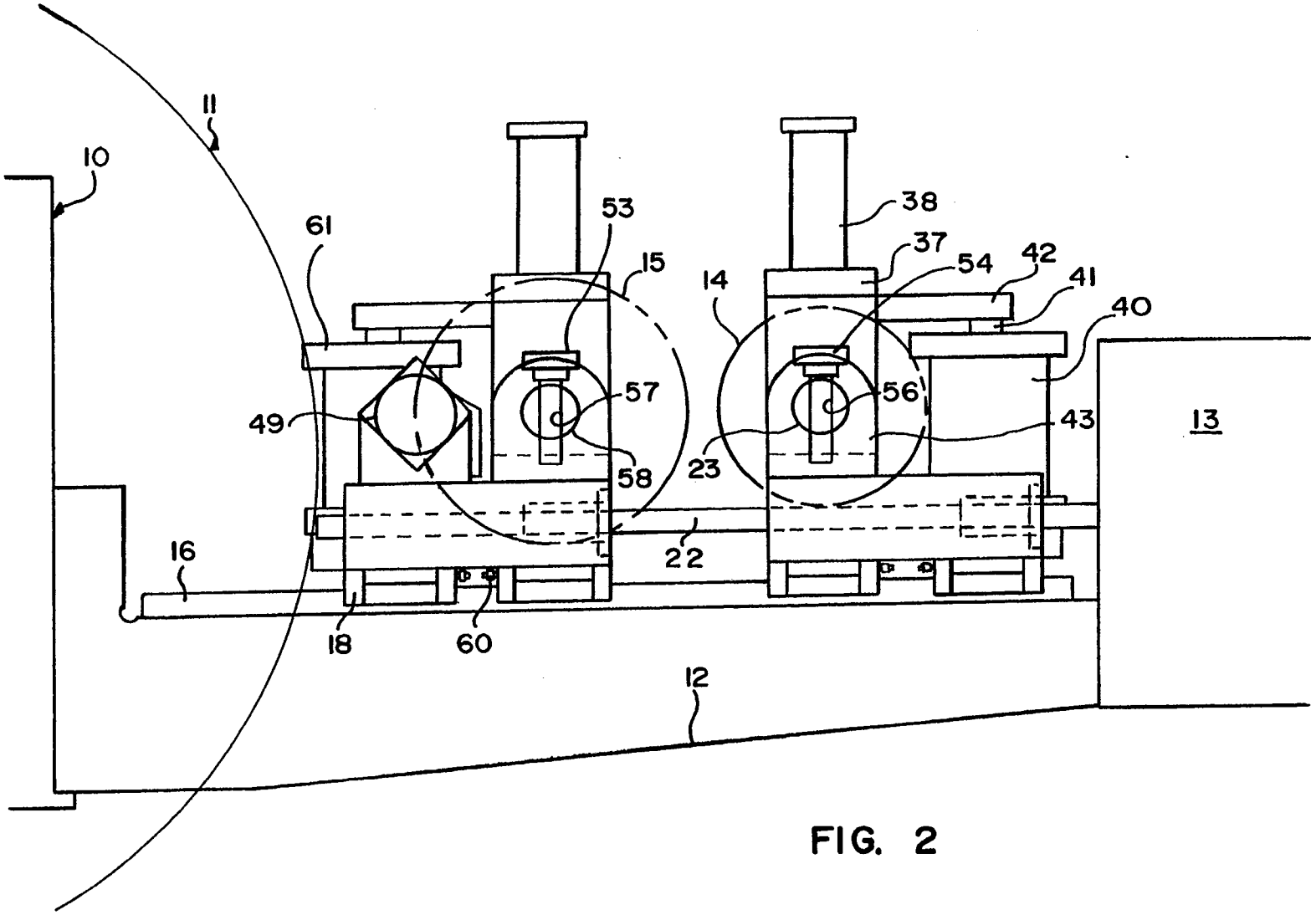
FIG. 2 is a side elevational view of the deck construction.

Now referring to FIG. 2, the details of an individual deck 12 can be seen. The deck frame 12 includes a pair of spaced-apart, upwardly facing linear bearing rails 16, 17—see also FIG. 3. Slidably mounted on the rail 16 are linear bearing blocks 18, 19 (see FIG. 2) and their opposite counterparts 20, 21 on rail 17—see FIG. 3. The blocks 18, 20 carry the plate roll 15 while the blocks 19, 21 carry the anilox roll 14. Also seen in FIG. 2 is a ball screw means 22 which extends into the enclosures 13 and is used to position the rolls 14, 15 relative to each other and to the impression cylinder 11.

ROLL CONSTRUCTION

For ease of description, the anilox roll will be described—and in conjunction with FIG. 4. Starting from the inside out, the numeral 23 designates an axially disposed, non-rotating mandrel, i.e., dead shaft 12 or mandrel. Ensleeved about the mandrel 23 is a sleeve assembly generally designated 24. The elements of sleeve assembly 24 can be more readily appreciated from FIG. 5 where the sleeve assembly 24 is partially removed from the mandrel 23.

Figure 5:
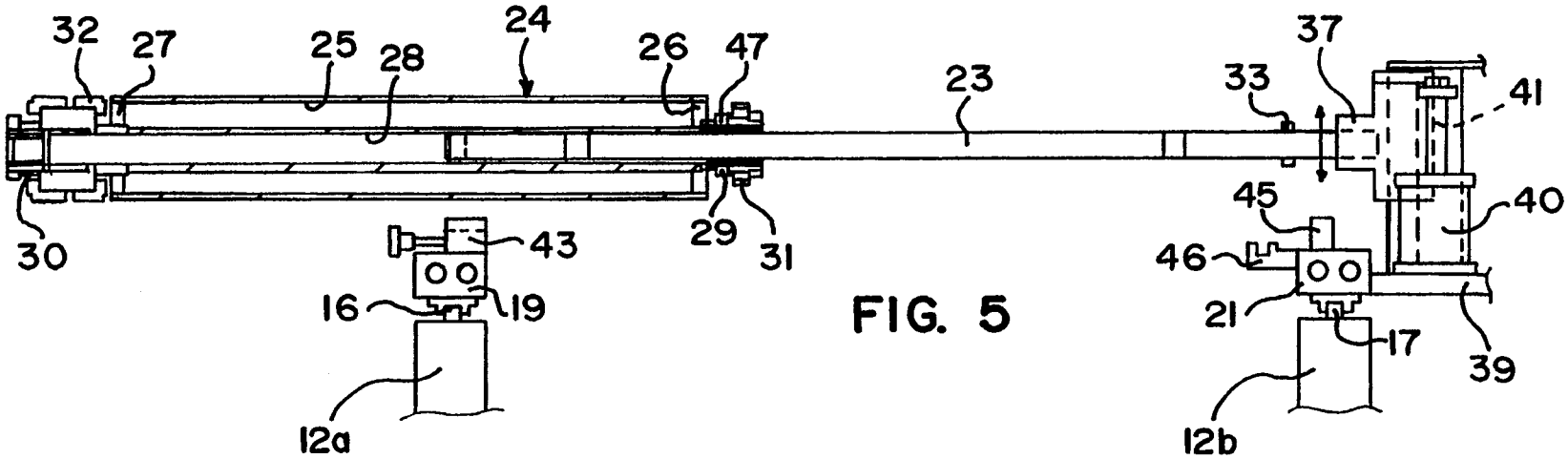
FIG. 5 is a view similar to FIG. 4 but showing the sleeve in the process of removal after being totally lifted.

The sleeve assembly includes an outer sleeve 25, end plates 26, 27 and an inner sleeve 28—this also being spaced radially from the mandrel 23, see especially the left hand end of FIG. 5 at 28. The sleeve assembly thus includes elements 25–28 and further roller bearings 29, 30 at the ends thereof. These are fixed to the sleeve assembly 24 and rotate on the mandrel 23.

Still referring to FIG. 5, the numeral 31 designates a positioning hub located adjacent the bearing 29. At the other end, the sleeve assembly 24 carries gearing 32—adjacent the bearing 30. Thus, all the elements needed for rotation are carried by the sleeve assembly 24 and the only element carried by the mandrel 23 is a stop 33—see the right hand end of FIG. 5.

Omitted from the drawings is the conventional drive gearing which engages, for example, the driven gearing 32 on the anilox roll. Such drive gearing also drives the driven gearing 34 on the plate roll 15—see the lower left hand portion of FIG. 3. Such drive gearing also drives the conventional bull gear 35 and the ring gear 36 associated with the central impression cylinder 11.

MANDREL SUPPORT

Figure 4:
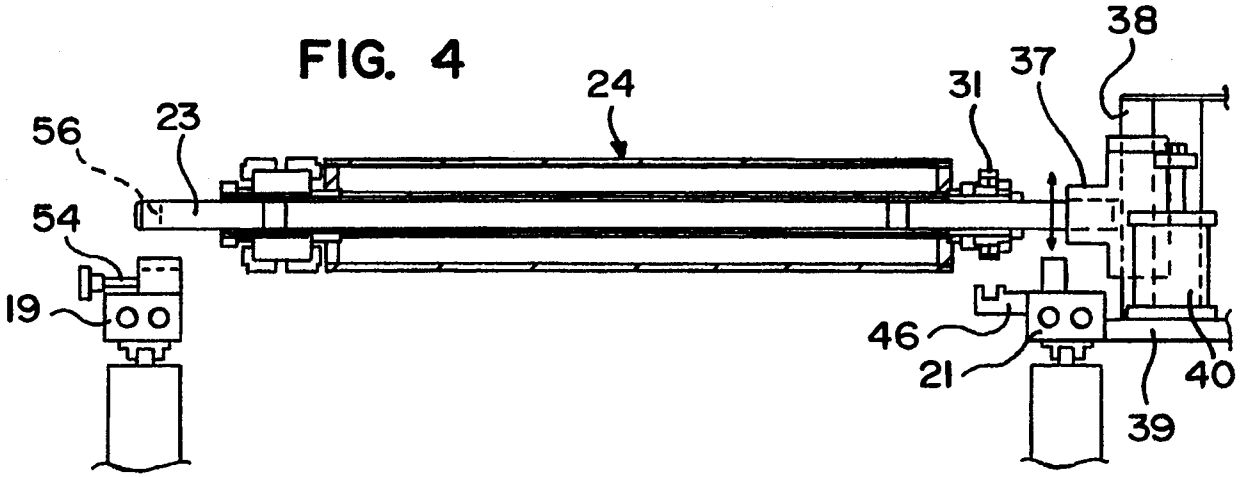
FIG. 4 is an end elevational view of the anilox roll of the preceding views in partially lifted condition.

At it supported end, the mandrel 23 is fixed to a bracket 37—see the upper right hand portion of either FIG. 4 or FIG. 5. The bracket 37 in turn is slidably mounted on a vertically extending guide 38. The guide 38 is rigidly mounted on a subframe 39 carried by the block 21. And the subframe 39 rigidly supports an air cylinder 40. The air cylinder 40 has a piston rod 41 which is connected to the bracket 37 by a horizontal arm 42—see also the right hand upper portion of FIG. 2. In FIG. 4, the mandrel 23 has been raised somewhat by the cylinder 40 but raised even further in FIG. 5 so as to clear the saddle 43 carried by the block 19—see the left hand portion of FIG. 5. A corresponding saddle is provided at the right hand end at 45. This is carried by the block 21 as is the holder 40 on the positioning hub 31.

As pointed our previously, the blocks 18–21 are carried on the rails 16, 17 which in turn are fixed to the deck frame 12—more especially the deck wings 12*a*, 12*b* as seen in FIG. 5. Also seen in FIG. 5 are two ball screws in each block 19, 21 so as to individually position the two rolls 14, 15. Further seen in FIG. 5 is a Sunday-drive gear 47 which permits the anilox roll to be turned over slowly to keep ink from setting therein—as when the plate roll is being changed or other press stoppage occurs.

PLATE ROLL

As mentioned previously, both rolls 14, 15 are essentially the same—having sleeve assemblies rotatably mounted on a dead shaft or stationary mandrel and with the mandrel liftable in cantilever fashion so as to permit unsleeving of the sleeve assembly therefrom.

The significant difference between the two rolls are the conventional ones—the gearing and the supports accommodate side and circumferential register. Circumferential register adjustments are made by side shifting gear hub 49 and helical gear 48—see the lower left of FIG. 3. Also seen mounted on frame 10 is gear hub holder 50.

However, these gears are located inside of deck frame 12*a* which is different from conventional practice and allows the gearing 48 to be changed with the sleeve assembly 51 on the plate roll 15.

In similar fashion, side register is developed by means provided inside the deck frame 12—this by the hub 52 and holder 53 which are inboard of the deck wing 12*b*—and which corresponds generally to the hub 31 and holder 46 described in conjunction with the anilox roll.

OPERATION

When a roll change is indicated for either plate roll 15 or anilox roll 14 or both, the press is stopped and the hand knob 54 or 55 or both (see the central portion of FIG. 2) is pivoted out of end slots 56 or 57 in the mandrels 23 and 58—the latter being associated with the plate roll 15, still referring to FIG. 2. The slot 56 in mandrel 23 can also be seen in FIG. 4 where the knob 54 has been pivoted to horizontal position. The knobs 54, 55 are also seen in the released or horizontal position, i.e., out of their respective mandrel slots in FIG. 3—see the lower central portion. There the knobs are seen to be pivotally mounted on shift hold down blocks 59, 60—and again in released or horisontal positin. Thereafter the air cylinders 40 (for the anilox roll mandrel) and 61 (for the plate roll mandrel) are actuated to raise the associated mandrels in cantilever fashion. Then, the sleeve assemblies 24, 50 may be removed as seen in FIG. 5.

While in the foregoing specification a detailed description of an embodiment of the invention has been set down for the sake of disclosing an operative embodiment pursuant to statute, many variations in the details hereingiven may be made by those skilled in the art without departing from the spirit and scope of the invention.

I claim:

1. A deck for a flexographic press comprising a frame adapted to be mounted on the press for movement relative to a central impression cylinder, a plate roll and an anilox roll each rotatably mounted on said frame, each of said rolls having an axially-extending stationary mandrel and a sleeve rotatably mounted on said mandrel and concentric thereto, gearing means mounted on each of said sleeves for rotating said sleeves, saddle means on said frame for supporting each mandrel adjacent each mandrel end, and lift means on said frame adjacent one end of each mandrel for cantilever raising each mandrel while freeing the mandrel other end from the saddle means whereby the associated sleeve can be removed for replacement.

2. The deck of claim 1 in which said other end saddle means is equipped with closure means.

3. The deck of claim 1 in which each sleeve is equipped with position hub means, said frame including a hub holder removably receiving said hub means.

4. The deck of claim 1 in which said lift means includes a pressure fluid cylinder and piston rod unit fixedly carrying bracket means, said mandrel being rigidly coupled to said bracket means.

5. The deck of claim 1 in which said frame includes a pair of side wings, a saddle mounted on each of said side wings, the saddle on the other of said side wings being equipped with closure means to cooperate with said lift means in maintaining said mandrel fixed in place during press operation.

6. A flexographic press comprising a main frame, a central impression cylinder rotatably mounted on said main frame, a plurality of deck frames mounted in circumferentially spaced relation about said cylinder, a plate roll and an anilox roll on each deck frame, each roll including a stationary mandrel and a sleeve assembly rotatably mounted on its associated mandrel, and means for moving said mandrel away from said deck frame to permit desleeving said sleeve assembly from said associated mandrel.

7. The press of claim 6 in which each sleeve assembly is equipped with gearing for rotating said sleeve assembly relative to its associated mandrel.

8. The press of claim 6 in which each sleeve assembly includes inner and outer sleeves, end plate means coupling said sleeves, bearing means on said inner sleeve outboard of said end plate means, said mandrel being received in said bearing means.

9. The press of claim 8 in which said inner sleeve is equipped with gearing.

10. A method of operating a flexographic press comprising the steps of providing a press having a plurality of decks each removably supporting a plate roll and an anilox roll, each roll including a sleeve rotatably mounted on a stationary mandrel and supported at the ends thereof, elevating one of said rolls to free it from support at one end, removing the sleeve from the mandrel over said one end, and replacing the first mentioned sleeve with another sleeve.

11. The method of claim 10 in which said steps include providing a deck frame and gearing on said sleeve inward of said frame.

12. The method of claim 10 in which said steps include replacing the sleeves of both of said rolls.

* * * * *